US005807056A

United States Patent [19]

Osborn et al.

[11] Patent Number: 5,807,056

[45] Date of Patent: Sep. 15, 1998

[54] RESIDENTIAL CONVERSION DEVICE FOR A WASTE COLLECTION VEHICLE

[75] Inventors: Warren W. Osborn, Barrington Hills; Ernest Szabo, Algonquin, both of Ill.

[73] Assignee: Qwik-Tip, Inc., Elk Grove, Ill.

[21] Appl. No.: 717,640

[22] Filed: Sep. 23, 1996

[51] Int. Cl.[6] ..... B65F 3/02

[52] U.S. Cl. ..... 414/406; 414/408; 414/420

[58] Field of Search ..... 414/303, 404, 414/406, 408, 409, 425, 419, 420, 421

[56] References Cited

U.S. PATENT DOCUMENTS

| | | | |
|---|---|---|---|
| 4,479,751 | 10/1984 | Wyman et al. | 414/406 |
| 4,575,300 | 3/1986 | George | 414/406 |
| 4,580,940 | 4/1986 | Sheaves | 414/406 |
| 4,613,271 | 9/1986 | Naab | 414/403 |
| 4,687,405 | 8/1987 | Olney | 414/408 |
| 4,741,658 | 5/1988 | Zelinka et al. | 414/406 |
| 4,773,812 | 9/1988 | Bayne et al. | 414/408 |
| 4,911,600 | 3/1990 | Zelinka et al. | 414/408 |
| 5,002,450 | 3/1991 | Naab | 414/403 |
| 5,024,573 | 6/1991 | Redding et al. | 414/408 |
| 5,069,593 | 12/1991 | Zelinka et al. | 414/408 |
| 5,119,894 | 6/1992 | Crawford et al. | 177/145 |
| 5,257,877 | 11/1993 | Zelinka et al. | 414/408 |
| 5,308,211 | 5/1994 | Bayne | 414/408 |
| 5,333,984 | 8/1994 | Bayne et al. | 414/408 |
| 5,466,110 | 11/1995 | Redding | 414/421 |
| 5,503,512 | 4/1996 | Bayne | 414/408 |
| 5,613,823 | 3/1997 | Bayne | 414/406 |

*Primary Examiner*—Karen B. Merritt
*Assistant Examiner*—Douglas A. Hess
*Attorney, Agent, or Firm*—Mathew R. P. Perrone, Jr.

[57] ABSTRACT

A device to convert a waste collection vehicle from a commercial waste collection vehicle to a residential waste collection vehicle is easily attached to a commercial waste collection vehicle, and has an upper clamp, which cooperates with a hydraulically powered lower clamp, to lift and dump a residential container.

14 Claims, 6 Drawing Sheets

RESIDENTIAL CONVERSION DEVICE FOR A WASTE COLLECTION VEHICLE

This invention relates to a device for picking up waste containers or carts, and more particularly to a device rendering a waste collection vehicle adaptable from a solely commercial waste collection vehicle to a combination of a residential waste collection vehicle and a commercial waste collection vehicle, for cart waste collection as well as commercial waste collection by the same vehicle.

BACKGROUND OF THE INVENTION

Waste collection and proper disposal thereof are of great importance to any civilized society. Such collections are important for health benefits and efficient management of resources.

Typically waste collection has two basic classes; (1) commercial and (2) residential. A typical synonym for commercial waste collection is industrial waste collection. A typical synonym for residential waste collection is home waste collection.

A typical, rear-loading, garbage or trash refuse collection vehicle, on a typical pickup run, includes a refuse body with a compacting device for reducing the volume of the garbage. In the rear of the vehicle is generally a receiving bay or hopper, which receives the refuse dumped therein. A blade and compacting device removes the garbage from the receiving area into a closed, interior, storage area of the vehicle.

This receiving area generally receives refuse, including trash and garbage, from one or more containers. If a large container is desired to be emptied into the hopper, it is desired to empty this larger container more efficiently, preferably by a mechanical means.

In particular, large receptacles, generally referred to as dumpsters, are difficult to efficiently dump into refuse collection vehicles. These dumpsters present laterally extending bar members (referred to as trunnion bars) from their upper front, and these bars are used as a combination grasping, lifting and dumping support for the container, in cooperation with a lower foot member.

Frequently a smaller container, also referred to as a cart, that is a container significantly smaller than a dumpster, must also be emptied. The device for emptying a dumpster is not generally compatible with the device for emptying a smaller container. If a modification can be made to the vehicle so that the same vehicle can also empty a smaller container or cart, the advantages become even more apparent.

While collection of trash and garbage is a required element in a modern society, it is, at best, an unpleasant task; and, at worst, an extremely arduous and uncomfortable task. Many factors are involved in efficiently achieving such collection. For efficient collection, in areas, especially commercial areas, where a large amount of trash and garbage is generated, it is desired to have a large container for receiving this garbage as opposed to a series of smaller containers or carts.

There is a major distinction in the waste disposal industry for the loading of a vehicle used for (1) commercial waste collection and (2) residential waste collection. This distinction is due to the size of the container. A mechanical lifting device cannot usually be modified to lift both types of containers.

A larger container, such as a refuse receptacle or a dumpster, typically used for waste storage at a commercial site, has a capacity measured in cubic meters or cubic yards. One type of large container is a trunnion bar type container. Usually the trunnion bar type container has an application at a commercial or industrial site or place of business. A commercial site can also include a multi-residential apartment or condominium site.

A smaller container, such as a cart, used for waste storage at a residential site or frequently at a light commercial site (such as a barber shop) has a capacity customarily measured in gallons or liters. This smaller container is a commonly a cart type container. Usually the cart (FIG. 9) has a pair of parallel lifting bars, which may be gripped, so that the cart can be lifted and dumped into a vehicle. Due to a customarily lower quantity of waste, the smaller container is generally useful for residential or light commercial purposes.

Both the size difference and the structure difference between the trunnion bar type container and the cart type container require a different lifting mechanism on a collection vehicle. Typically, the commercial or industrial waste collection is accomplished by a truck having a modification designed to pick up the trunnion bar containers.

There is, however, no effective method or device for effectively and mechanically lifting a cart type container, using the same vehicle designed to lift and dump the larger containers. This size difference between the larger container and the smaller cart requires different lifting and dumping devices. This smaller cart is customarily emptied manually, when the vehicle can only lift and dump the large container. Thus, typically a different vehicle is required for lifting each type of container.

Clearly, the commercial containers are much larger than the residential containers. There is no effective way to easily convert from commercial collection to residential collection and vice versa. What is common in the industry today is the provision of separate vehicles for mechanical residential collection and mechanical commercial collection. There is no simple efficient way to provide for residential and commercial waste collection on the same vehicle.

This requirement for separate vehicles for commercial and residential waste collection clearly creates a problem, when a commercial vehicle is in the area where the waste collection company also has some residential accounts, or smaller commercial accounts. The cost of sending a second vehicle to an area, where a first vehicle is present, is costly in terms of both vehicle wear and employee time. Thus an efficient manner of adapting a commercial waste collection vehicle for double-duty use as a residential vehicle can provide great advantages.

If such a vehicle can accomplish both commercial and residential pick-ups, more mechanically than manually, on the same trip, a second vehicle trip can be eliminated. The increased pick-up capability creates savings in employee time, and vehicle wear and tear.

SUMMARY OF THE INVENTION

Among the many objectives of this invention is the provision of a device to permit a waste collection vehicle to be used as both its originally intended commercial waste collection vehicle as well as a residential waste collection vehicle.

Another objective of this invention is to provide a device to permit commercial waste collection vehicle to accomplish residential pickups on the same trip.

Yet another objective of this invention is to provide a device, which minimizes the necessity of sending two waste collection vehicles to the same area, route or run.

Still another objective of this invention is to provide a device, which simplifies waste collection.

Also, an objective of this invention is to provide a device, which may efficiently use employee time.

Additionally, an objective of this invention is to provide a method of attaching an efficient dumping device to provide a waste collection vehicle with residential mechanical collection capabilities as well as commercial mechanical collection capabilities on the same vehicle during the same pick-up run.

Also, an objective of this invention is to provide an efficient dumping apparatus which can assist with the emptying of both a heavy commercial refuse container and a lighter residential refuse container.

A further objective of this invention is to provide an efficient dumping apparatus, which minimizes damage to a vehicle.

A still further objective of this invention is to provide an efficient dumping apparatus, which is adaptable to a smaller refuse container.

Yet a further objective of this invention is to provide an efficient dumping apparatus, which minimizes damage to a refuse container.

These and other objectives of the invention (which other objectives become clear by consideration of the specification, claims and drawings as a whole) are met by providing a device which permits a waste collection vehicle for mechanical commercial waste collection purposes vehicle to be used as a mechanical residential waste collection vehicle, thereby providing a dual function for the vehicle.

BRIEF DESCRIPTION OF DRAWINGS

Throughout the figures of the drawings where the same part appears in more than one figure, the same number is applied thereto.

DESCRIPTION OF THE PREFERRED EMBODIMENTS

Figure 1:
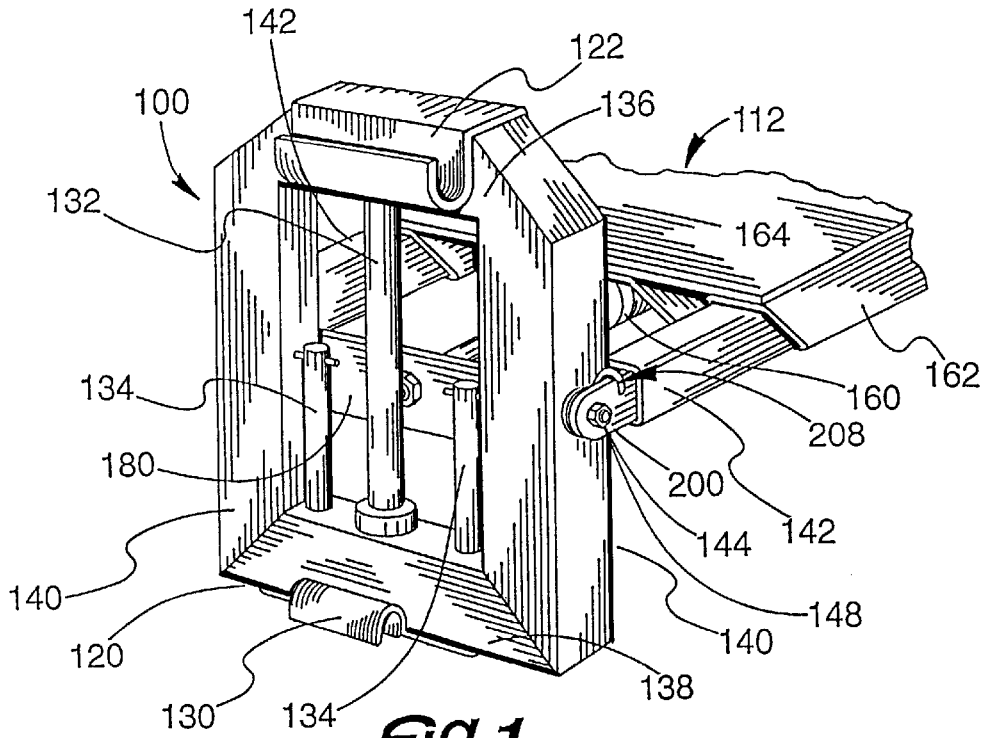
FIG. 1 depicts a front, perspective view of a residential dumping device 100 in accordance with the present invention.

A device of this invention; rendering a waste collection vehicle adaptable from an automatic or mechanical commercial waste collection vehicle to a combination of an automatic or mechanical, residential or commercial waste collection vehicle; is easily attached to a commercial waste collection vehicle. In this manner, a single vehicle can substantially mechanically or automatically, as opposed to substantially manually, empty both a commercial waste container and a residential waste container.

Thus it becomes possible to lift, invert, and dump both a refuse receptacle (for example a dumpster) with its capacity measured in cubic meters or cubic yards, and a cart with its capacity measured in liters or gallons with the same vehicle. Either container is, thus, dumped into the hopper of a rear-loading refuse collecting vehicle. This residential waste collection device does not interfere with the commercial device. It is also easily operable by the current vehicle structure without substantial modification.

While it is clear that a dumpster may be used for both residential and commercial purposes, it is sometimes referred to as a commercial receptacle for the purposes of this application. Likewise, while it is clear that a cart may be used for both residential and commercial purposes, lighter commercial purposes such as barber shop, it is sometimes referred to as a residential receptacle for the purposes of this application.

This residential tipping device is especially suitable for use on a commercial device attached to a vehicle, such as that described in U.S. Pat. No. 5,425,613 to Warren Osborne, incorporated herein by reference. For the purposes of this application, the terms tipping or dumping may be used interchangeably.

Basically, the residential tipping device includes a frame. To the frame are secured two arms. The arms are permanently secured to the frame and may be removably secured to the vehicle. The frame is generally rectangular in shape and is supported by the arms at the sides thereof. The top and bottom of the frame include the attaching devices or holders for gripping and dumping the residential containers.

Each of these arms is slidably mounted in a sleeve secured to the vehicle. Since the sleeve is preferably hollow or tubular in nature, a stopping device is secured on the end of each arm opposite the frame. A nut is secured in the sleeve. Then a mating bolt combines with the nut to secure a washer in position to provide a stop. The washer is, of course, too large to pass through the sleeve; and thereby stops each arm, so that it may not exit the sleeve when the residential tipping device is in operation.

At the top of the frame is a fixed upper holder, which joins to the container to help in the lifting. The top member of the frame supports the upper holder within the frame and provides for a simple attachment of the device to the container. The lower holder protrudes from a plate on lower part of the frame. The plate is attached to the frame by two arms which are pinned or otherwise secured thereto. In this fashion, the lower holder may be efficiently attached and secured to the frame of the device.

The tip bar cylinder is the first device to start the dumping procedure for a container, by moving the tip bar. Mounted adjacent to the tip bar is the support arm. The support arm serves to activate a cam switch. The cam switch activates after the residential container has been lifted by the upper holder. As the cam switch is activated, a pneumatic cylinder extends, thereby pushing the lower holder downwardly to thereby position the lower holder in the lower hook of the residential container. The lower holder thus cooperates with the fixed upper holder to hold the residential container as required. In this fashion, the residential trash container is maintained on the tipping device without dropping into the truck.

The pneumatic cylinder is the preferred operating mechanism for the residential tipping device. It is preferred over a manual operation, because of the speed and safety with which dumping can be accomplished. Also, the pneumatic cylinder is preferred to a hydraulic cylinder operation, because of the speed and safety with which dumping can be accomplished, and the simplified maintenance therefor.

With this structure of the residential tipping device for easy mounting on the vehicle, and the retained ability to empty either residential trash container or commercial dumpster with the same vehicle, great advantages are obtained. The residential tipping device includes a frame with a brace support centrally located on each side member of the frame, and connects the side members. With this structure, the frame thus is braced and greater strength is obtained.

The brace support member also provides for the extension retraction cylinder to be mounted. A standard nut and bolt assembly permits the pneumatically operated cylinder to be attached to the frame, and permits a mechanical extension of the frame as desired.

A displacement of the frame from the vertical is desired for efficient gripping of the residential trash container. This position is best accomplished with a spring. One end of the spring contacts the support arm attaching the frame to the vehicle. The opposing end of the spring contacts the side of the frame. The center coil of the spring can be mounted on the bolt or other assembly device.

Referring now to FIG. 1, residential tipping device 100 includes a frame 120. At the top of the frame 120 is mounted an upper holder 122. At the bottom of the frame 120 is mounted a lower holder 130. The lower holder 130 is pneumatically operated by a holder locking cylinder 132. A pair of side holder guides 134 are oppositely disposed on either side of the holder locking cylinder 132.

More particularly, the frame 120 includes an upper support member 136, on which the upper holder 122 is secured, and a lower support member 138, to which the lower holder 130 abuts. Side support members 140 brace the upper support member 136 and the lower support member 138, thereby completing a generally rectangular shape.

The holder locking cylinder 132 is slidably mounted in the lower support member 138 and is secured to lower holder 130. Lower holder 130 abuts lower support member 138 until the lifting of a cart or residential waste container 116 (FIG. 9) is desired.

On each side member 140 is a support arm 142 which are received in the body of vehicle 112. Each support arm 142 is supported on a nut and bolt assembly 144 combined with a spring 208, which permits the tilting or positioning of the residential dumping device 100 to be operated or adjusted appropriately, upon extension.

Figure 2:
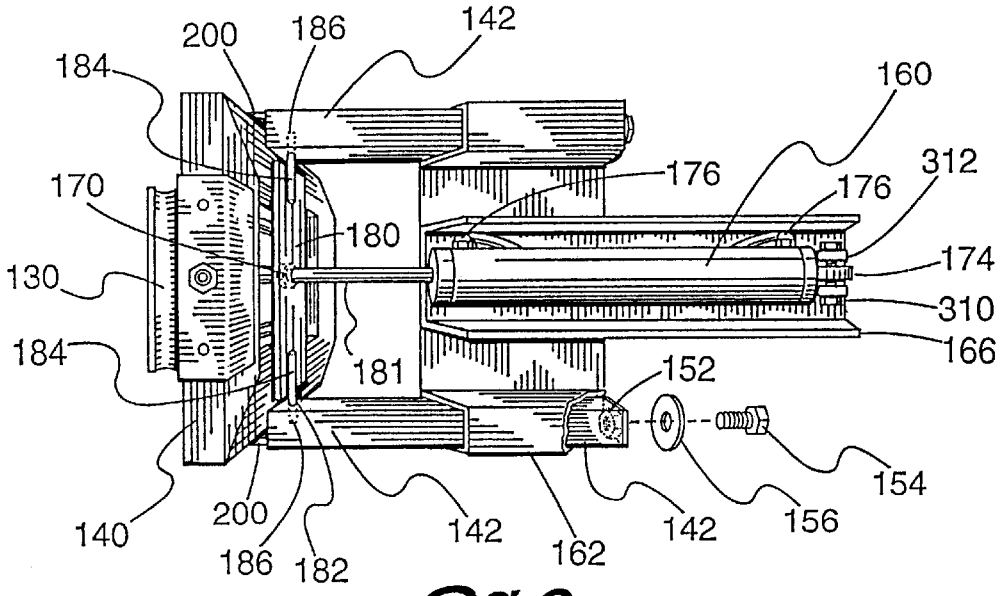
FIG. 2 depicts a bottom view of a residential dumping device 100 in accordance with the present invention.

Adding FIG. 2 to the consideration, the frame 120 is secured to each arm 142. A center plate 180 is of sufficient length to be secured to each arm 142 by pinning, welding, bolting or other suitable device. Pinning is preferred.

At each end of the center plate 180, is a plate pin 182. Plate pin 182 is a rod secured at first pin end 184 to plate 180. Plate pin 182 includes a second pin end 186 oppositely disposed from first pin end 184. Each second pin end 186 is rotatably mounted in its respective support arm 142. Thus, the two plate pins 182 provide for a limited or partial rotation of center plate 180 about a horizontal axis set forth thereby.

Figure 5:
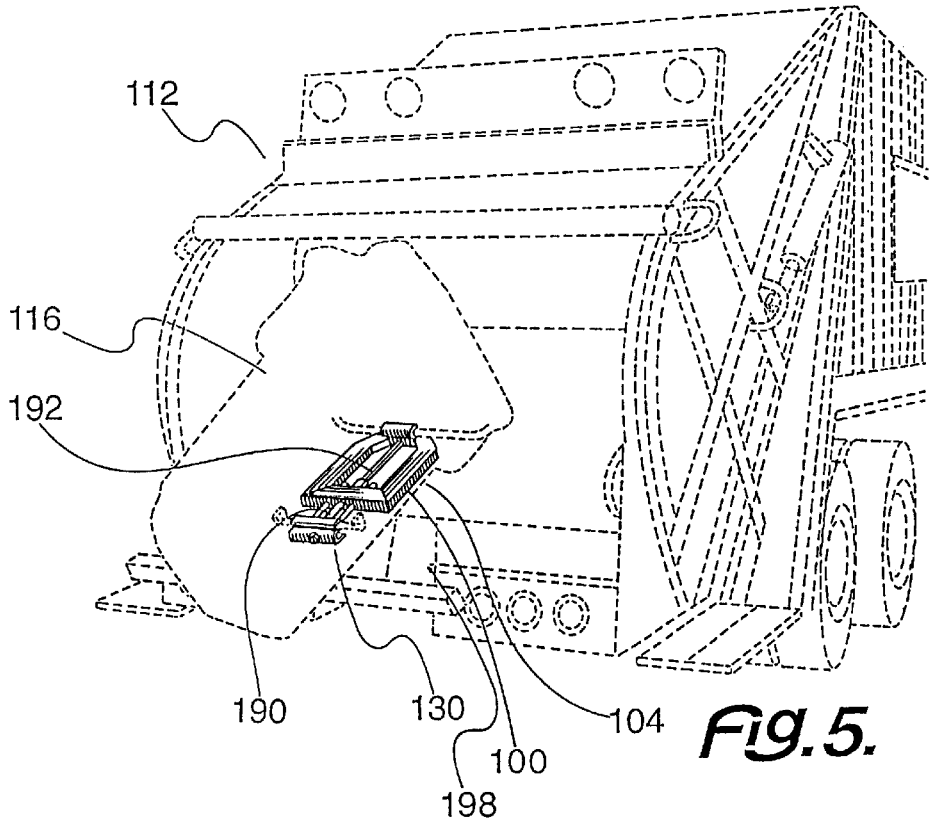
FIG. 5 depicts a front, perspective view of a residential dumping device 100 of the apparatus of FIG. 1 in operation.

Adding FIG. 5 to the discussion of FIG. 1 and FIG. 2, the structure of holder locking cylinder 132 may be seen. Holder locking cylinder 132 includes an outer sleeve 192, with an inner sliding piston 190. The inner sliding piston 190 is bolted or otherwise secured to lower holder 130 and pneumatically actuated to operate lower holder 130 as desired. The outer sleeve 192 is secured to plate 136 by a first nut and bolt assembly 310 (FIG. 10), for support purposes.

Referring back to FIG. 1 and FIG. 2, the frame 120 is seen as mounted on the opposing support arms 142. The support arms 142 are mounted in the support cradles 162. Thus, the extension retraction cylinder 160 permits an automatic or pneumatic activation or retraction of the residential tipping device 100.

The holder locking cylinder 132 for lower holder 130 is actuated and moved downwardly when activated to lock the lower holder 130 in place. More particularly, the support arms 142 are shown as having attitude spring 208. Each spring 208 supports the frame 120 and permits the residential waste container 116 to be handled.

The support cradles 162 are braced by a support plate 164. Within support plate 164 is a cylinder housing 166 to which the extension retraction cylinder 160 may be mounted by standard nut and bolt assemblies 310. Rod end 181 of extension retraction cylinder 160 is received in a plate nut 170, mounted on center plate 180. The cylinder end 174 of the extension retraction cylinder 160 includes a pair of mounting ears 312 to be received in a pair of mounting bars centrally located at one end of the cylinder housing 166.

A pair of air supply fittings 176, mounted to opposing ends of the extension retraction cylinder 160, assists in supplying the required air to activate the extension retraction cylinder 160. Support cradles 162 are mounted on the vehicle 112. Cylinder housing 166 is mounted on support plate 164.

Figure 3:
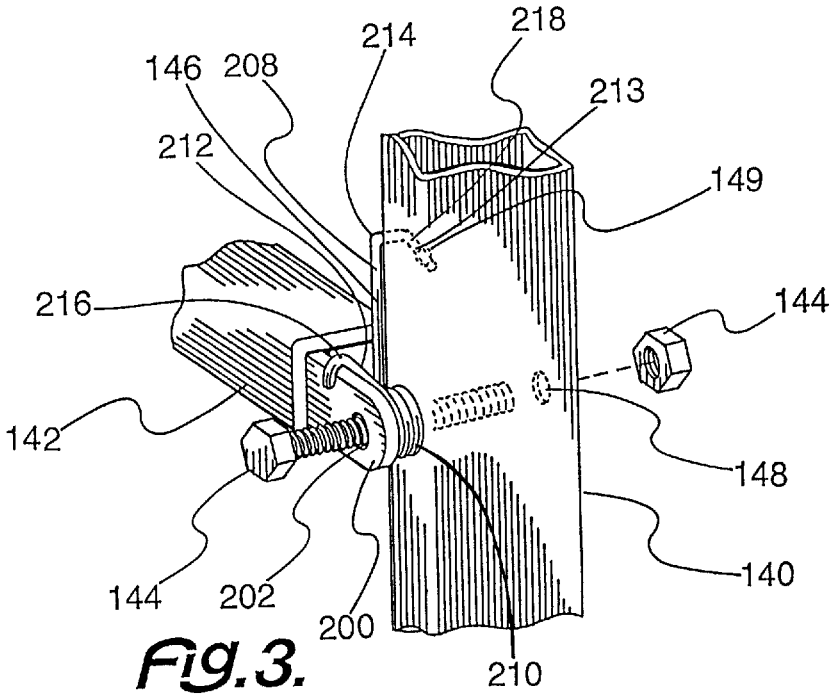
FIG. 3 depicts a perspective view of an attitude spring 208 for the residential dumping device 100 of the present invention.

Referring now to FIG. 3, the spring 208 is depicted. The side support arm 142 includes at the end thereof a flange 200. Flange 200 includes a flange aperture 202. Flange aperture 202 cooperates with side support aperture 148 to receive a nut and bolt assembly 144 to mount frame 120 and hence residential tipping device 100 on vehicle 112.

Also mounted adjacent to flange aperture 202 and around that nut and bolt assembly 144 is spring 208. Spring 208 includes a center coil 210 of spring 208 mounted around the nut and bolt assembly 144. Extending from center coil 210 is a first arm 212 and an oppositely disposed second arm 214. The first arm 212 of the attitude spring 208 contacts the side support member 140 with an arc hook end 216. Arc hook end 216 loops over flange 200 and is situated on flange 200 between flange aperture 202 and support arm 142. The second arm 214 terminates in straight hook end 213 formed by a right angle bend 218. Straight hook end 213 fits into an aperture 149 in side support member 140.

In FIG. 3, the side support member 140 includes a support member side aperture 148 to receive nut and bolt assembly 144. Between flange 200 and side support member 140 is mounted a dual arm spring 208, which positions the side support member 140 in a proper position. Nut and bolt assembly 144 passes through the flange aperture 202 through the center coil 210 of the dual-arm, attitude spring 208 into the side support arm 140, by means of support member side aperture 148. This completes the nut and bolt assembly 144 and positioning of the attitude spring 208.

Figure 4:
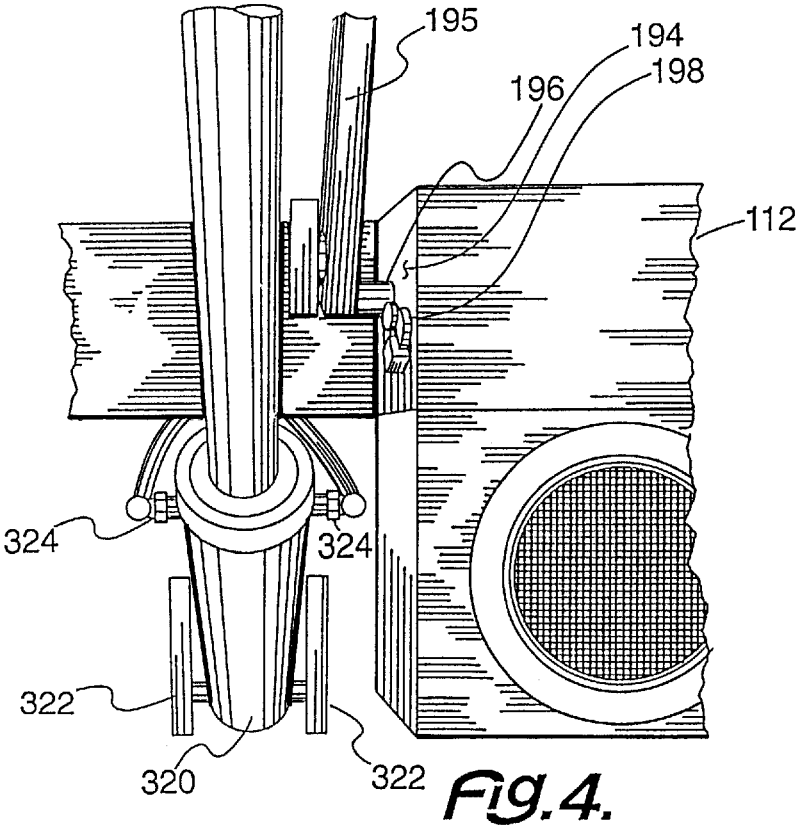
FIG. 4 depicts a perspective view of the cam actuation mechanism 194 for the residential dumping device 100 of FIG. 1 and its relation to commercial dumping device as described in the below-cited Osborne Patent.

FIG. 4 depicts the prior art of the Osborne patent and its relation to the residential tipping device 100 of this invention. Some of the modifications to vehicle 112 for attaching the residential tipping device 100 are shown in combination with a part of the commercial tipping device described in the cited Osborne Patent, in particular the tip bar cylinder 320 being depicted therein. The tip bar cylinder 320 of the commercial tipping device cooperates with the residential tipping device 100.

The tip bar cylinder 320 is mounted between a pair of hydraulic supports 322. Selective activation occurs with the use of hydraulic hoses 324. The hydraulic hoses 324 are attached in a standard fashion.

The cam actuation mechanism 194 has the cam arm 195 with cam 196 mounted thereon, which in turn, actuates an electric switch 198 and extends the holder locking cylinder 132 (FIG. 1). Electric switch 198 is a three position switch having one position operating the residential tipping device 100, and the other two positions operating the commercial tipping device, in general, and tip bar cylinder 320, in particular.

Figure 6:
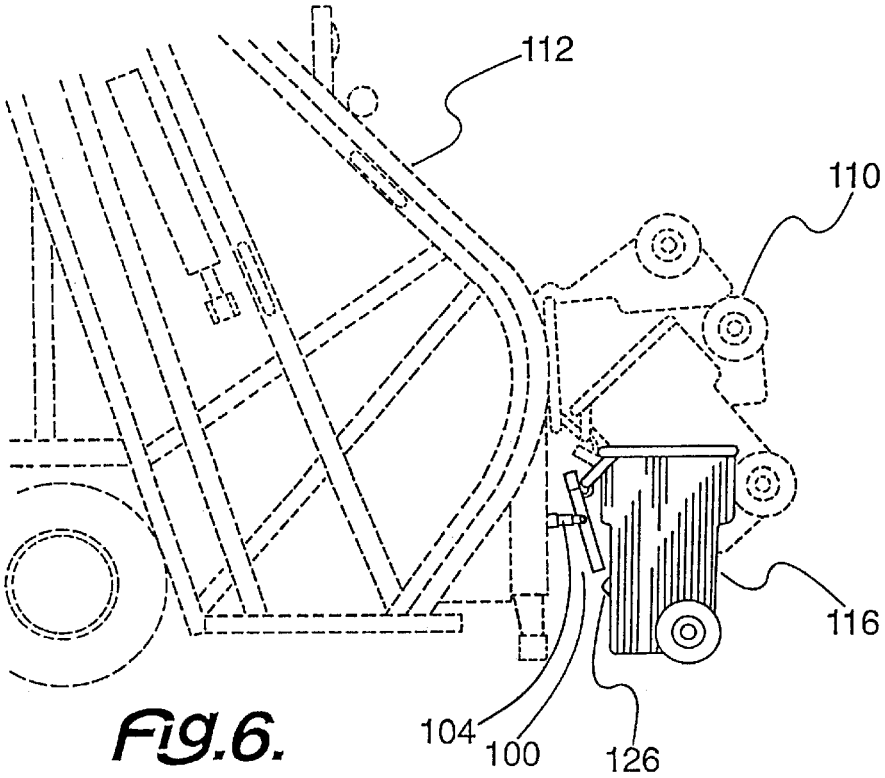
FIG. 6 depicts a side view of a residential dumping device 100 of the apparatus of FIG. 1 showing the sequence of the dumping operation 110.

Adding FIG. 5 and FIG. 6 to the consideration, the major functions of the residential tipping device 100 are depicted. Using electric switch 198, holder locking cylinder 132 sets lower holder 130 and moves lower holder 130 in a downward position to latch onto the residential waste container 116. After the residential tipping device 100 is extended appropriately, and upper holder 122 latches onto the residential waste container 116 shown in FIG. 9, lower holder 130 is activated through holder locking cylinder 132. Container 116 may then be dumped.

Figure 7:
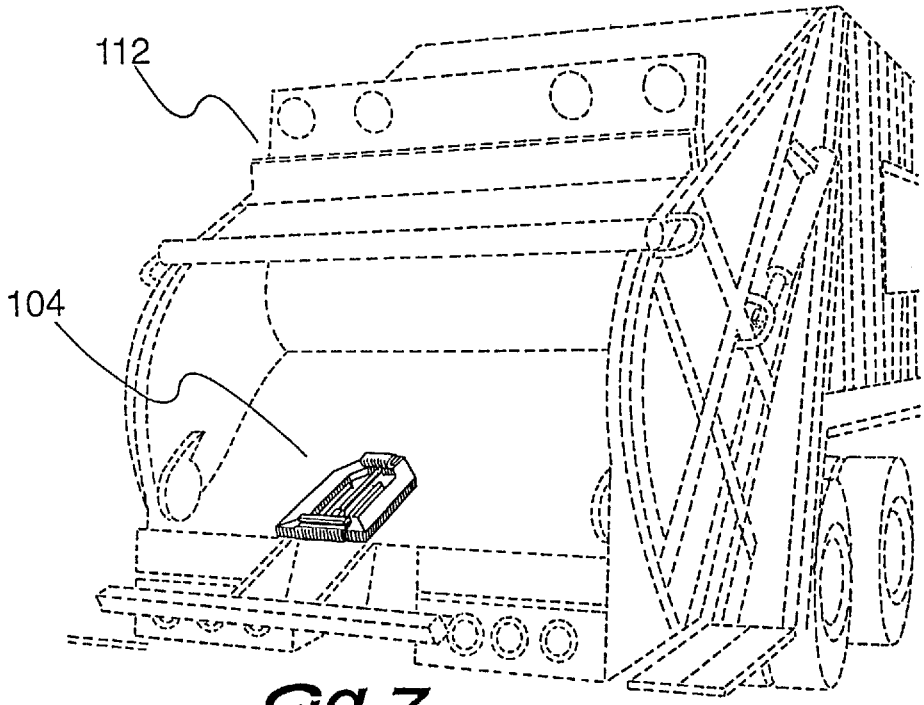
FIG. 7 depicts a perspective view of a residential dumping device 100 of the apparatus of FIG. 1 showing its movement while mounted on a vehicle 112.
Figure 8:
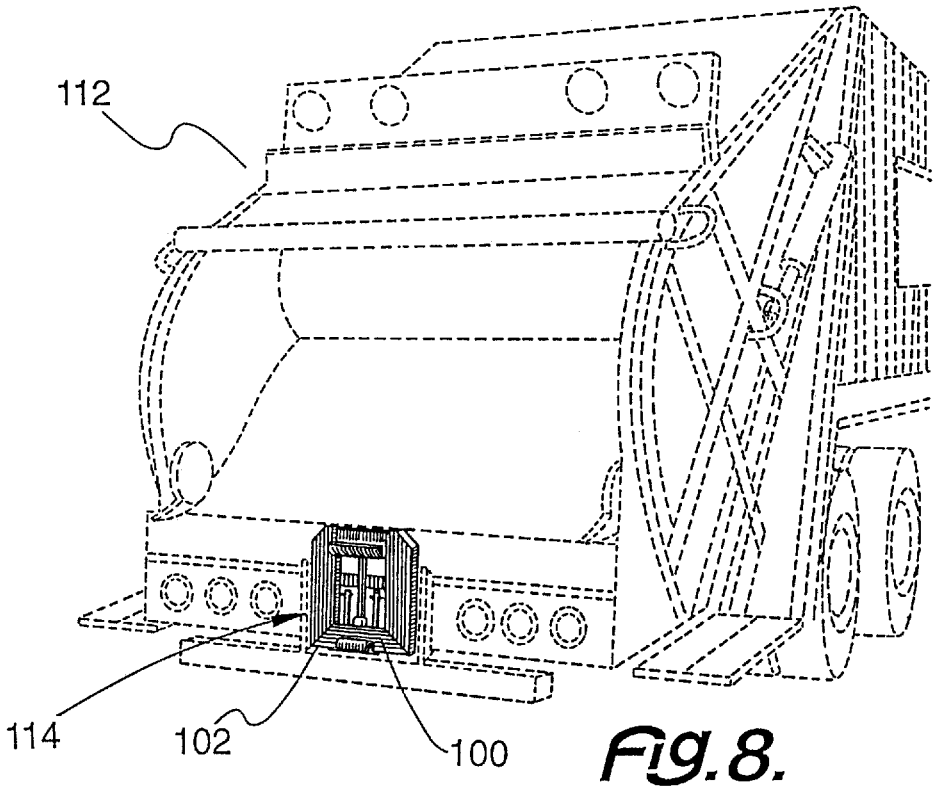
FIG. 8 depicts a perspective view of a residential dumping device 100 of the apparatus of FIG. 1 showing the mounting on a vehicle 112, while in a stored position 114.

FIG. 7 and FIG. 8 combine to show the residential tipping device 100 in a stored position 102 from FIG. 8. The in use position 104 is depicted in FIG. 7. It is clearly possible to eliminate the pneumatic system and manually extend the device 100 to the residential container 116. Whether the clamping is accomplished pneumatically or manually, residential tipping device 100 works well for its desired purpose of having a vehicle, such as vehicle 112, serve both as commercial waste collector or a residential waste collector. The pneumatic system is preferred.

Figure 9:
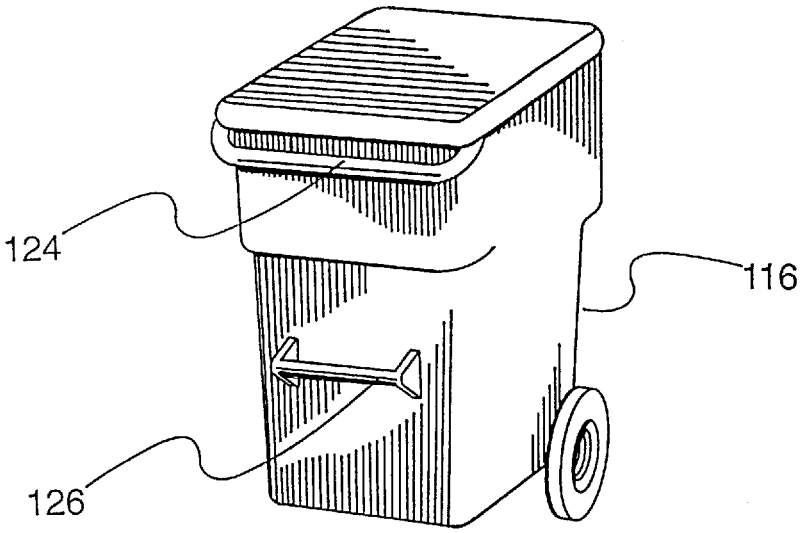
FIG. 9 depicts a perspective view of a residential waste container 116 for use with residential dumping device 100.

FIG. 9 depicts a perspective view of a residential waste container 116 for use with residential dumping device 100. Upper holder 122 fits into upper bar 124, while lower holder 130 fits into lower bar 126 of residential waste container 116 for gripping and dumping purposes. Upper bar 124 may also serve as a handle for moving residential waste container 116.

With FIG. 5, FIG. 6, FIG. 7, FIG. 8, and FIG. 9, it is clear that residential dumping device 100 works well when required, and does not interfere with the commercial tipping device of the cited Osborne patent. The separate functions of the residential dumping device 100 and the commercial tipping device are each used as required.

Figure 10:
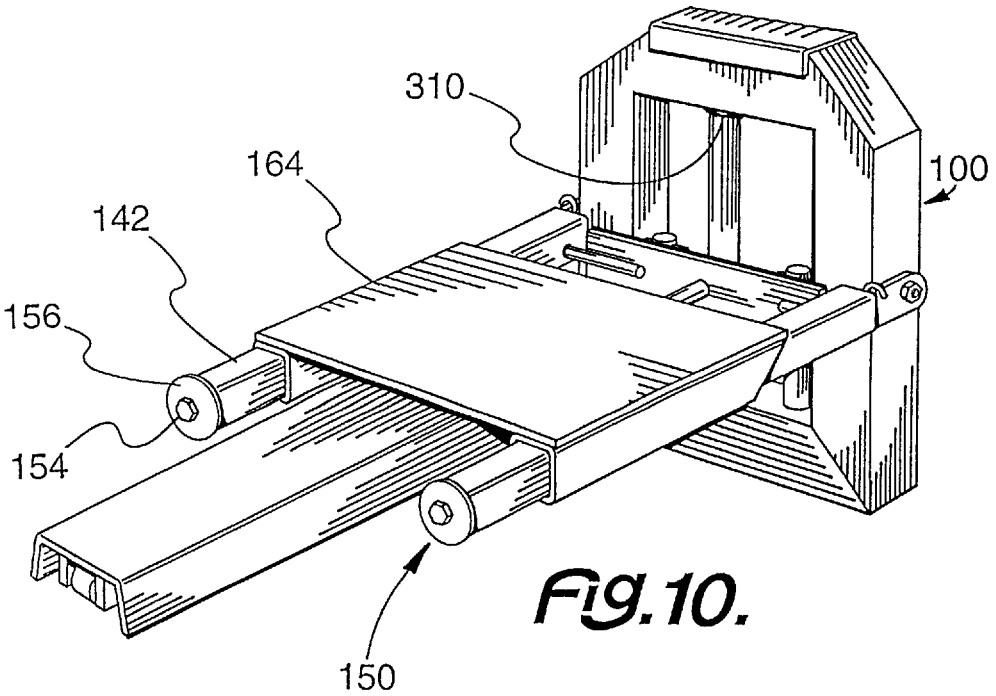
FIG. 10 depicts a perspective view of an arm stopping device 150 for use with residential dumping device 100, partially shown in an exploded, reverse view in FIG. 2.

In FIG. 10 combined with FIG. 6 to more completely depict arm stopping device 150 for use with residential dumping device 100, relies on support cradle 162 to receive support arm 142. Each support cradle 162 is similar to a sleeve, with tubular function, and is secured to the vehicle 112. Since the support cradle 162 is preferably hollow or tubular, a stopping device 150 is secured on the end of each arm 142 opposite the frame 120.

More particularly, as shown FIG. 2, which is a partial, reverse perspective view of FIG. 10, a nut 152 is secured to each arm 142 by welding or other suitable manner. Then the nut 152 combines with bolt 154 to secure a washer 156 on the bolt 152 and provide the stopping device 150. The washer 156 is, of course, too large to pass through the support cradle 162; and thereby prevents each arm 142 separating from and leaving cradle 162.

Figure 11:
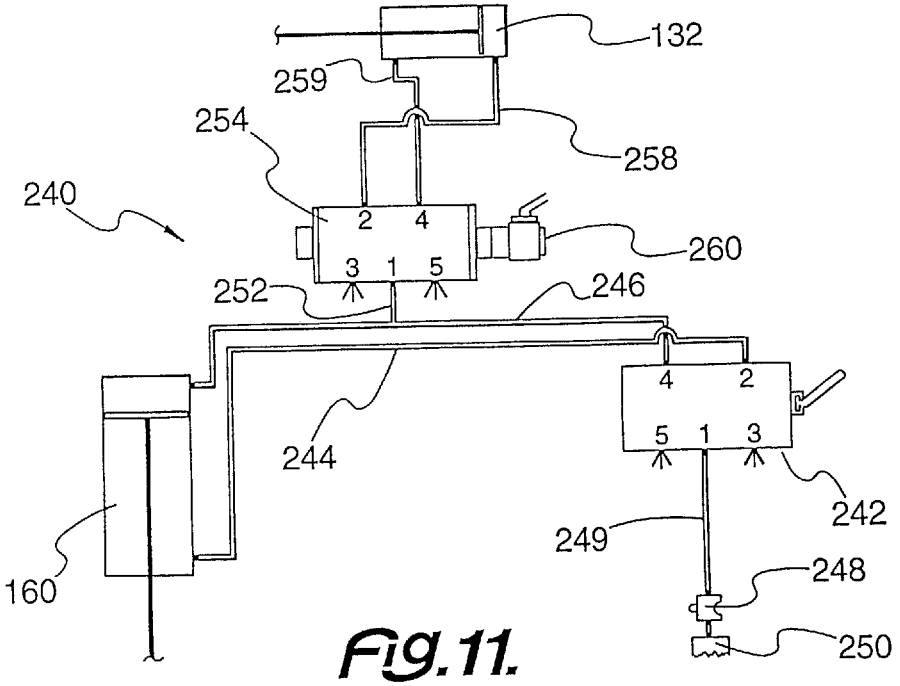
FIG. 11 depicts a pneumatic diagram 240 for the operation of extension retraction cylinder 160.

Referring now to FIG. 11, the extension retraction cylinder 160 is activated by a pneumatic system as shown in pneumatic diagram 240. In particular, the extension retraction cylinder 160 is connected to a pneumatic toggle switch 242 by inlet hose 244 and outlet hose 246. The pneumatic toggle switch 242 is also connected by a protection hose 249 to an air pressure protector valve 248. Air pressure protector valve 248 is connected to the air supply 250 of vehicle 112.

Interrupting the hose 246 is a T-Line 252 connected to an air manifold 254. Air manifold 254 is connected to a lock cylinder 132 by a first standard air line 258 and a second standard air line 259. Air manifold 254 is also connected to control circuit 260.

Figure 12:
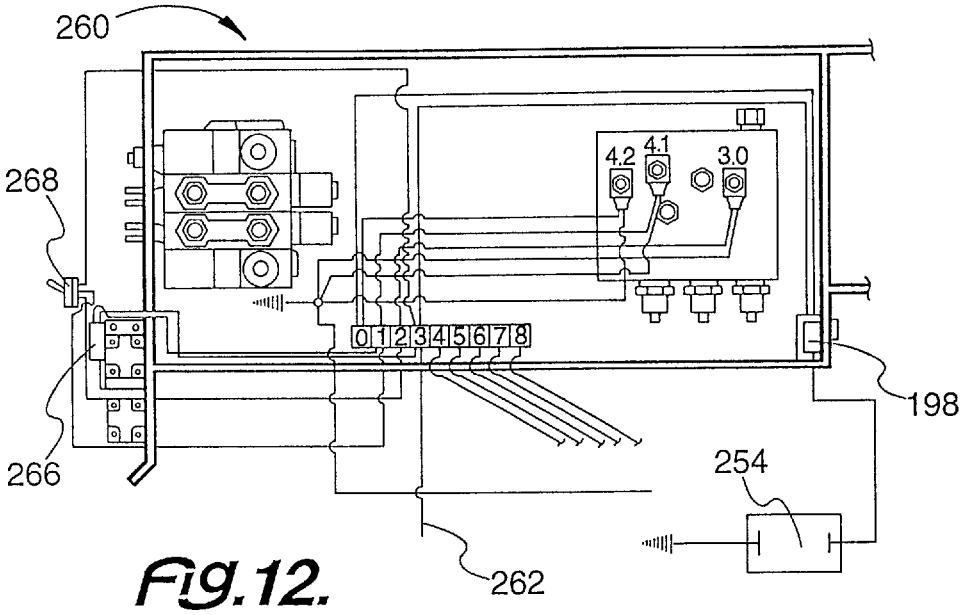
FIG. 12 depicts a control circuit 260 for pneumatic diagram 240 in order to operate extension retraction cylinder 160.

In FIG. 12, the depiction of control circuit or wiring schematic 260 is completed. The electric switch 198 is wired into schematic 260 in a standard fashion. The wiring schematic 260 provides a control circuit connected to the truck power source 262 and wired in standard fashion through the vehicle electrical system. An activation switch 266 with an override switch 268 is connected also in the wiring schematic 260 to permit safety operations in case of any problems.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A residential tipping device for converting a commercial waste collection vehicle to a residential waste collection vehicle, comprising:

(a) the residential tipping device including a frame, an activation means, a vehicle mounting means and a clamping means;

(b) the frame supporting the activation means, the vehicle mounting means and the clamping means;

(c) the activation means being adapted to store or activate the residential tipping device as required;

(d) the clamping means being adapted to grip a residential trash container;

(e) the residential tipping device including a cooperating control means;

(f) the clamping means including an upper clamp and a lower clamp;

(g) the upper clamp and the lower clamp having a capability to receive the residential trash container;

(h) the cooperating control means including an extension means for the residential tipping device;

(i) the vehicle mounting means including a first mounting arm and a second mounting arm mounted on the frame;

(j) the first mounting arm being oppositely disposed from the second mounting arm;

(k) the upper clamp being oppositely disposed from the lower clamp;

(l) the first mounting arm being situated on a first side of the frame, and between the upper clamp and the lower clamp;

(m) the second mounting arm being situated on a second side of the frame, and between the upper clamp and the lower clamp;

(n) the upper clamp being substantially fixed;

(o) the lower clamp being mounted on a movable plate;

(p) a positioning means for the movable plate;

(q) a secondary support means including a first arm and a second arm;

(r) the frame including an upper support member supporting the upper clamp and connecting the first side to the second side;

(s) the frame including a lower support member being oppositely disposed from the upper support member and supporting the lower clamp and connecting the first side to the second side;

(t) the positioning means including a cam switch;

(u) the cam switch being adjacent to the lower support member;

(v) a support arm secured to the frame capable of contacting the cam switch upon movement of the frame;

(w) the plate extending as the residential container is lifted and retracted as it lowered;

(x) the plate serving to lock the lower clamp onto the residential container;

(y) a plate support cylinder supporting the plate on the frame; and (z) the secondary support means supporting the plate on the frame.

2. The residential tipping device of claim 1 further comprising:

(a) a brace support connecting the first side of the frame to the second side of the frame;

(b) the brace support member receiving an extension means for the residential tipping device; and (c) a spring assembly providing a proper attitude for the frame.

3. The residential tipping device of claim 2 further comprising:

(a) the extension means being an extension, retraction, pneumatically powered cylinder;

(b) the lower clamp being operated by a clamp locking cylinder; and (c) a pair of side clamp guides being oppositely disposed on either side of the clamp locking cylinder to support and guide the lower clamp.

4. The residential tipping device of claim 3 further comprising:

(a) a center plate being mounted in the frame and including a first plate pin at least partially rotatably mounted within the first side of the frame;

(b) the center plate including a second plate pin at least partially rotatably mounted within the second side of the frame;

(c) the spring assembly including a coil with a first arm extending therefrom; and (d) the coil having a second arm extending therefrom and being opposite to the first arm.

5. The residential tipping device of claim 4 further comprising:

(a) the first arm terminating in a straight hook end;

(b) the straight hook end fitting a side support aperture;

(c) the second arm terminating in an arcuate hook end; and (d) a nut and bolt assembly receiving the coil, the support arm and a frame side selected from the group consisting of the first side and the second side.

6. The residential tipping device of claim 5 further comprising:

(a) the extension, retraction, pneumatically powered cylinder causing the support arm to contact the cam switch and extend the lower clamp to grip the residential container;

(b) the extension, retraction, pneumatically powered cylinder causing the support arm to release the cam switch and retract the lower clamp to release the residential container; and (c) the lower clamp accomplishing the releasing and attaching of the residential container.

7. A method of emptying a residential trash container into a vehicle comprising:

(a) extending a residential tipping device from a stored position;

(b) partially attaching the tipping device to the residential trash container;

(c) lifting the residential trash container;

(d) securing the tipping device to the residential trash container to form a use position;

(e) dumping the residential trash container;

(f) lowering the residential trash container;

(g) partially releasing the tipping device from the residential trash container;

(h) placing the residential trash container in a desired position;

(i) completely releasing the tipping device from the residential trash containers;

(j) securing the residential trash container as a movable lower clamp is extended;

(k) releasing the residential trash container as the movable lower clamp is retracted;

(l) the residential tipping device including a frame, an activation means, a vehicle mounting means and a clamping means;

(m) the frame supporting the activation means, the vehicle mounting means and the claiming means;

(n) the activation means being adapted to store or activate the residential tipping device as required;

(o) the clamping means being adapted to grip a residential trash container;

(p) the residential tipping device including a cooperating control means;

(q) the vehicle mounting means including a first mounting arm and a second mounting arm mounted on the frame;

(r) the first mounting arm being oppositely disposed from the second mounting arm;

(s) the clamping means including an upper clamp and a lower clamp;

(t) the upper clamp and the lower clamp having a capability to receive the residential trash container;

(u) the cooperating control means including a pneumatic extension means for activating the residential tipping device;

(v) the upper clamp being oppositely disposed from the lower clamp;

(w) the first mounting arm being situated on a first side of the frame, and between the upper clamp and the lower clamp;

(x) the second mounting arm being situated on a second side of the frame, and between the upper clamp and the lower clamp;

(y) the upper clamp being substantially fixed;

(z) the lower clamp being mounted on a movable plate, the movable plate including a positioning means;

(aa) the tipping device further provided with a secondary support means including a first arm and a second arm;

(bb) the frame further provided with an upper support member supporting the upper clamp and connecting the first side to the second side;

(cc) the frame further provided with a lower support member being oppositely disposed from the upper support member and supporting the lower clamp and connecting the first side to the second side;

(dd) the positioning means further provided with a cam switch;

(ee) the cam switch being adjacent to the lower support member;

(ff) the tipping device further provided with a support arm secured to the frame capable of contacting the cam switch upon movement of the frame;

(gg) the plate extending as the residential container is lifted and retracted as it is lowered;

(hh) the plate serving to lock the lower clamp onto the residential container;

(ii) the tipping device further provided with a plate support cylinder for supporting the plate on the frame; and (jj) the secondary support means also supporting the plate on the frame.

8. A residential tipping device for converting a commercial waste collection vehicle to a residential waste collection vehicle, comprising:

(a) the residential tipping device including a frame, an activation means, a vehicle mounting means and a clamping means;

(b) the frame supporting the activation means, the vehicle mounting means and the clamping means;

(c) the activation means being adapted to store or activate the residential tipping device as required;

(d) the clamping means being adapted to grip a residential trash container;

(e) the residential tipping device including a cooperating control means;

(f) the vehicle mounting means including a first slidable mounting arm and a second slidable mounting arm mounted on the frame;

(g) the first mounting arm being oppositely disposed from the second mounting arm;

(h) the clamping means including an upper clamp and a lower clamp; and (i) the first slidable mounting arm and the second slidable mounting arm being secured to the frame and slidably mounted relative to the vehicle mounting means.

9. The residential tipping device of claim 8 further comprising:

(a) the upper clamp and the lower clamp having a capability to receive the residential trash container;

(b) the cooperating control means including a pneumatic extension means for activating the residential tipping device;

(c) the upper clamp being oppositely disposed from the lower clamp;

(d) the first mounting arm being situated on a first side of the frame, and between the upper clamp and the lower clamp;

(e) the second mounting arm being situated on a second side of the frame, and between the upper clamp and the lower clamp;

(f) the upper clamp being substantially fixed;

(g) the lower clamp being mounted on a movable plate; and (h) a positioning means for the movable plate.

10. The residential tipping device of claim 9 further comprising:

(a) a secondary support means including a first arm and a second arm;

(b) the frame including an upper support member supporting the upper clamp and connecting the first side to the second side;

(c) the frame including a lower support member being oppositely disposed from the upper support member and supporting the lower clamp and connecting the first side to the second side;

(d) the positioning means including a cam switch;

(e) the cam switch being adjacent to the lower support member;

(f) a support arm secured to the frame capable of contacting the cam switch upon movement of the frame;

(g) the plate extending as the residential container is lifted and retracted as it lowered;

(h) the plate serving to lock the lower clamp into a lower hook of the residential container; and (i) a plate support cylinder supporting the plate on the frame.

11. The residential tipping device of claim 10, further comprising:

(a) a brace support connecting the first side of the frame to the second side of the frame;

(b) the brace support member receiving an extension means for the residential tipping device;

(c) a spring assembly providing a proper attitude for the frame;

(d) the secondary support means supporting the plate on the frame;

(e) the extension means being an extension, retraction, pneumatically powered cylinder;

(f) the lower clamp being operated by a clamp locking cylinder; and (g) a pair of side clamp guides being oppositely disposed on either side of the clamp locking cylinder to support and guide the lower clamp.

12. The residential tipping device of claim 11 further comprising:

(a) a center plate including a first plate pin at least partially rotatably mounted within the first side of the frame;

(b) the center plate including a second plate pin at least partially rotatably mounted within the second side of the frame;

(c) the spring assembly including a coil with a first arm extending therefrom; and (d) a first coil having a second arm extending therefrom and being opposite to the first arm.

13. The residential tipping device of claim 12 further comprising:

(a) the first arm terminating in a straight hook end;

(b) the straight hook end fitting into a side support aperture;

(c) the second arm terminating in an arcuate hook end; and (d) a nut and bolt assembly receiving the coil, the support arm and a frame side selected from the group consisting of a first side and a second side.

14. The residential tipping device of claim 13 further comprising:

(a) the extension, retraction, pneumatically powered cylinder causing the support arm to contact the cam switch and extend the lower clamp to grip the residential container;

(b) the extension, retraction, pneumatically powered cylinder causing the support arm to release the cam switch and retract the lower clamp to release the residential container; and (c) the lower clamp accomplishing the releasing and attaching of the residential container.

* * * * *